US007801321B2

(12) United States Patent
Akino

(10) Patent No.: US 7,801,321 B2
(45) Date of Patent: Sep. 21, 2010

(54) CONDENSER MICROPHONE

(75) Inventor: Hiroshi Akino, Machida (JP)

(73) Assignee: Kabushiki Kaisha Audio-Technica, Machida-shi (JP)

( * ) Notice: Subject to any disclaimer, the term of this patent is extended or adjusted under 35 U.S.C. 154(b) by 1140 days.

(21) Appl. No.: 11/408,085

(22) Filed: Apr. 21, 2006

(65) Prior Publication Data

US 2006/0251274 A1 Nov. 9, 2006

(30) Foreign Application Priority Data

May 6, 2005 (JP) ..... 2005-134824

(51) Int. Cl.
*H04R 9/08* (2006.01)
*H04R 3/00* (2006.01)

(52) U.S. Cl. ..... 381/355; 381/361; 381/369

(58) Field of Classification Search ..... 381/355
See application file for complete search history.

(56) References Cited

U.S. PATENT DOCUMENTS 3,718,862 A * 2/1973 Norris ..... 455/95
3,825,874 A * 7/1974 Peverill ..... 439/579
4,261,628 A * 4/1981 Gallagher et al. ..... 439/95

FOREIGN PATENT DOCUMENTS

| | | |
|---|---|---|
| JP | 09-83463 | 3/1997 |
| JP | 10-336794 | 12/1998 |
| JP | 2000-165982 | 6/2000 |
| JP | 2000-232700 | 8/2000 |
| JP | 2003-143679 | 5/2003 |
| JP | 2004-23705 | 1/2004 |

* cited by examiner

*Primary Examiner*—Brian Ensey
*Assistant Examiner*—Sunita Joshi
(74) *Attorney, Agent, or Firm*—Oblon, Spivak, McClelland, Maier & Neustadt, L.L.P.

(57) ABSTRACT

In a condenser microphone in which a microphone unit section is replaceable, an electromagnetic wave is prevented without fail from entering into an internal circuit through a coupled portion of the microphone unit section and a microphone case and generation of noises caused by the electromagnetic wave is prevented. The condenser microphone has a microphone case, a unit case which is detachably attached to the microphone case and incorporates a condenser microphone unit, a circuit substrate contained in the microphone case, and an electric path which electrically connects a rear end of the unit case with the circuit substrate in a state that the unit case is attached to the microphone case, wherein the electric path electrically connects the rear end of the unit case with the circuit substrate via an inductor.

6 Claims, 5 Drawing Sheets

(RELATED ART)

(RELATED ART)

CONDENSER MICROPHONE

BACKGROUND OF THE INVENTION

1. Field of the Invention

The present invention relates to a condenser microphone in which a microphone unit section can be attached to and detached from a microphone case and, more particularly, to a condenser microphone in which a microphone unit section can be arbitrarily replaced with, for example, a nondirectional microphone unit section or a unidirectional microphone unit section and an increase in noise due to the fact that a microphone unit section is made replaceable can be suppressed.

2. Related Background of the Invention

Since an impedance of a microphone unit is high, an impedance converter composed of a field effect transistor (FET) etc. is used in a condenser microphone. Further, in order to fulfill performance necessary as a microphone or perform required functions, an output circuit, a low cut circuit, etc., are incorporated in the microphone.

On the other hand, there is a condenser microphone in which a microphone unit section can be replaced depending on purposes. For example, there is a condenser microphone, in which it is possible to selectively replace and attach a nondirectional microphone unit section and a unidirectional microphone unit section. A unit replacement mechanism of a condenser microphone capable of replacing its microphone unit section is generally designed into a structure in which a unit case that incorporates a microphone unit is attached to a microphone case by a screw. A sound signal to be converted into an electric signal and output in the microphone unit is transmitted to the microphone case side via an electric contact, its impedance is converted by an impedance converter contained in the microphone case, and the converted sound signal is output to the outside after being subjected to predetermined process such as low cut process.

FIG. 4 and FIG. 5 show a conventional example of a condenser microphone capable of replacing its microphone unit section depending on purposes. In FIG. 4 and FIG. 5, symbol 1 denotes a microphone case and symbol 3 denotes a microphone unit section. The microphone case 1 has a female screw 19 on the inner circumferential surface at the front end (the left end in FIG. 4 and FIG. 5) portion and the microphone unit section 3 has a male screw 32 on the rear end portion, and it is structured such that the microphone unit section 3 can be attached to the microphone case 1 by screwing the male screw 32 into the female screw 19.

The microphone unit section 3 has a substantially cylindrical unit case 31, and a condenser microphone unit 30 is attached near the front end of the unit case 31. Since the condenser microphone unit 30 has a general unit configuration conventionally known, its detailed description is omitted. The front end of the unit case 31 is covered with a front cover 39 having a plurality of slit-like sound introduction holes. An inner side end plate 33 is engaged with and fixed to the rear end side of the unit case 31 and an outer side end plate 34 is engaged with and fixed to the further outside. A flanged contact 38 is inserted from inside into a hole formed at the center of the outer side end plate 34. A rod-like terminal 36 is inserted into a hole formed at the center of the inner side end plate 33 from outside toward inside and the terminal 36 is fixed to the inner side end plate 33 in a state of protruding toward the microphone unit 30. A compression spring 37 made of a conductor is interposed in the holes at the centers of the inner side end plate 33 and the outer side end plate 34, the contact 38 is pressed toward the outside of the outer side end plate 34 by a repulsion of the compression spring 37, and the rear end portion of the contact 38 which is formed into a semispherical shape protrudes from the outer side end plate 34. To the front end portion of the rod-like terminal 36, an output terminal plate 35 extending backward from the microphone unit 30 is screwed. Therefore, a sound signal converted by the microphone unit 30 is transmitted to the output terminal plate 35, the terminal 36, the compression spring 37, and the contact 38.

The microphone case 1 mainly comprises a relatively elongated cylindrical case 11. An end plate 16 is engaged with and fixed to the inner circumferential surface of the front end portion of the cylindrical case 11, located adjoining the female screw 19 and on the rear side thereof. A contact 20 is engaged with and fixed to the end plate 16 so as to penetrate its center in the direction of thickness. A circuit substrate 15 is attached to the inside of the cylindrical case 11 along its length direction. On the circuit substrate 15, an impedance converter circuit composed mainly of the FET, the low cut circuit, the output circuit, and the like are incorporated. The contact 20 is connected to an input terminal of the circuit substrate 15 via a proper conductive material. A connector case 12 is engaged with and fixed to a rear end portion of the cylindrical case 11 by a screw etc. A connector base 13 having insulation properties is fixed in the connector case 12. Three conductive pins 14 are buried in the connector base 13, constituting a connector having a standardized three-pin configuration. An output terminal and a ground terminal of the output circuit formed on the circuit substrate 15 are electrically connected with the corresponding pins, respectively.

FIG. 4 shows a state in which the microphone unit section 3 is attached to the microphone case 1 by screwing the male screw 32 of the unit case 31 into the female screw 19 of the cylindrical case 11. In this state, the contact 38 of the microphone unit section 3 comes into contact with the front end of the contact 20 on the microphone case 1 side and the contact 38 is pressed against the contact 20 by a compressive force of the compression spring 37, thereby the contact 38 and the contact 20 are electrically connected with each other. Therefore, a sound signal converted in the microphone unit 30 and output therefrom is input to the input terminal of the circuit substrate 15 via the output terminal plate 35, the terminal 36, the compression spring 37, the contact 38, and the contact 20. On the circuit substrate 15, a predetermined process such as impedance conversion, low cut, and amplification is performed and an output signal is transmitted to the three pins 14 as an output terminal. One of the three pins 14 is a ground pin connected to the ground. Into the connector case 12, a connector plug conforming to the standards is inserted, and a signal is input to an external circuit via the three pins 14 and a microphone cord.

According to the conventional condenser microphone described above, the microphone case 1 and the microphone unit section 3 are electrically connected with each other by screwing the male screw 32 into the female screw 19, therefore, the microphone case 1 and the microphone unit section 3 serve as a ground and function as a shielding member against an external electromagnetic wave.

However, the coupled portion of the microphone case 1 and the microphone unit section 3 is a path of an electromagnetic wave that enters from the outside and also a path of a signal of a sound signal on the grounding side, therefore, its structure allows a sound signal to be subject to the electromagnetic wave. In other words, the coupled portion by screw of the microphone case 1 and the microphone unit section 3 has an impedance for a high frequency signal, therefore, an electromagnetic wave is likely to enter into an internal circuit from the coupled portion and the electromagnetic wave that has entered into the internal circuit is detected by a semiconductor constituting the internal circuit and generates noises. In particular, when a signal current flows through the coupled portion by screw, the noises increase. Recently, a mobile phone prevails widely and in the situation in which a mobile phone is used frequently everywhere, it is more likely to occur that a mobile phone is used in the vicinity of a condenser microphone and an electromagnetic wave emitted from a mobile phone enters through the coupled portion and causes noises to be output from the condenser microphone.

As an invention described in a patent document relating to the condenser microphone according to the present invention, there is an invention as follows. In a condenser microphone in which a microphone capsule including a microphone unit is made replaceable to a grip part that incorporates an electric circuit for sound signal output, it is made possible to easily adjust a sensitivity when replacing a capsule by providing, for example, two capacitors for pads in the microphone capsule and making it possible to selectively connecting the capacitors for pads in parallel to the effective capacitance of the microphone unit using a selection switch (for example, refer to the patent document 1).

The object of the invention described in the patent document 1 is to make the microphone capsule including the microphone unit replaceable to the grip part and to make it possible to easily adjust the sensitivity when replacing the capsule. Therefore, as will be described later, its object is different from that of the invention of the present application, which object is to prevent noises due to the electromagnetic wave that tries to enter through the coupled portion of the microphone unit section and the microphone case in the condenser microphone in which the microphone unit section is made replaceable.

As an invention described in another patent document relating to the condenser microphone according to the present invention, there is an invention, that is, a unidirectional electret condenser microphone comprising a back electrode holder made of an insulating material and which engages and fixes a back electrode plate constituting an electrode on one side and a lead wire ring which is attached internally to the back electrode holder and electrically connects the back electrode holder with a printed circuit board, wherein an IC chip including a capacitor for removing high frequency noises, an inductor, and other circuit elements is contained in a back electrode chamber formed inside the back electrode holder and attached to the printed circuit board (for example, refer to the patent document 2).

The invention described in the patent document 2 comprises the inductor for removing high frequency noises, however, its object is different from that of the invention of the present application, which object is to prevent noises due to the electromagnetic wave that tries to enter through the coupled portion of the microphone unit section and the microphone case in the condenser microphone in which the microphone unit section is made replaceable.

As an invention described in still another patent document, there is a vibration pickup microphone using a ceramic bimorph element, in which even if a mobile phone is used near the microphone, a filter composed of an inductor and a capacitor is interposed between the ceramic bimorph element and a FET as an impedance converting circuit in order to avoid a digital noise from the mobile phone (for example, refer to the patent document 3).

The object of the invention described in the patent document 3 is to avoid a digital noise when a mobile phone is used in the vicinity of a microphone, therefore, its object is different from that of the invention of the present application, which object is to prevent noises due to the electromagnetic wave that tries to enter through the coupled portion of the microphone unit section and the microphone case in the condenser microphone in which the microphone unit section is made replaceable.

Further, a configuration is also known, in which an inductor as an impedance element is inserted in series with a transmission wave signal output line of a microphone at a position close to the microphone and the impedance element is used to prevent the intrusion of the radio transmission wave signal induced in the above transmission wave signal output line into the microphone (for example, refer to the patent document 4).

The invention described in the patent document 4 has disclosed that the impedance element connected in series with the transmission wave signal output line of the microphone are effective to avoid noises due to the electromagnetic wave, however, its object is different from that of the invention of the present application, which object is to prevent noises due to the electromagnetic wave that tries to enter through the coupled portion of the microphone unit section and the microphone case in the condenser microphone in which the microphone unit section is made replaceable.

[Patent document 1] Japanese Patent Application Laid-Open No. 2004-23705

[Patent document 2] Japanese Patent Application Laid-Open No. 2000-232700

[Patent document 3] Japanese Patent Application No. Hei 10-336794

[Patent document 4] Japanese Patent Application Laid-Open No. Hei 09-83463

SUMMARY OF THE INVENTION

The present invention has been developed in consideration of the above-mentioned problems of the conventional condenser microphone, and an object thereof is to provide a condenser microphone in which a microphone unit section can be detachably attached to a microphone case and which is capable of preventing without fail an electromagnetic wave from entering into an internal circuit through a coupled portion of the microphone unit section and the microphone case and of preventing generation of noises due to the electromagnetic wave.

The present invention is characterized as the most main feature by comprising a microphone case, a unit case that can be detachably attached to the microphone case and incorporates a condenser microphone unit, a circuit substrate contained in the microphone case, and an electric path that electrically connects a rear end of the unit case with the circuit substrate in a state in which the unit case is attached to the microphone case, wherein the electric path electrically connects the rear end of the unit case with the circuit substrate via an inductor.

The unit case is detachably attached to the microphone case and if a plurality of kinds of unit case or microphone unit section having different specifications of the incorporated condenser microphone unit is prepared, it is possible to use the microphone as a microphone having specifications suited for the intention of a user by selecting a unit case or a microphone unit section having any specifications and attaching it to the microphone case in accordance with the use conditions and the like of the microphone. When the rear end of the unit case is electrically connected with the circuit substrate in the microphone case via the inductor in a state in which the unit case is attached to the microphone case, the unit case functions not only as a microphone case but also as an electric path on the ground side of a sound current and a high frequency current. In the microphone case, the microphone case, which is an electric path on the grounding side of the high frequency current, and the electric path on the ground side of the circuit substrate, which is an electric path on the ground side of the sound current, are separated, therefore, the electric path on the circuit substrate is isolated from the high frequency current and it is unlikely that noises caused by the high frequency current mixedly enters into the sound circuit, and a clear sound signal with less noises can be obtained.

DESCRIPTION OF THE PREFERRED EMBODIMENTS

Figure 1:
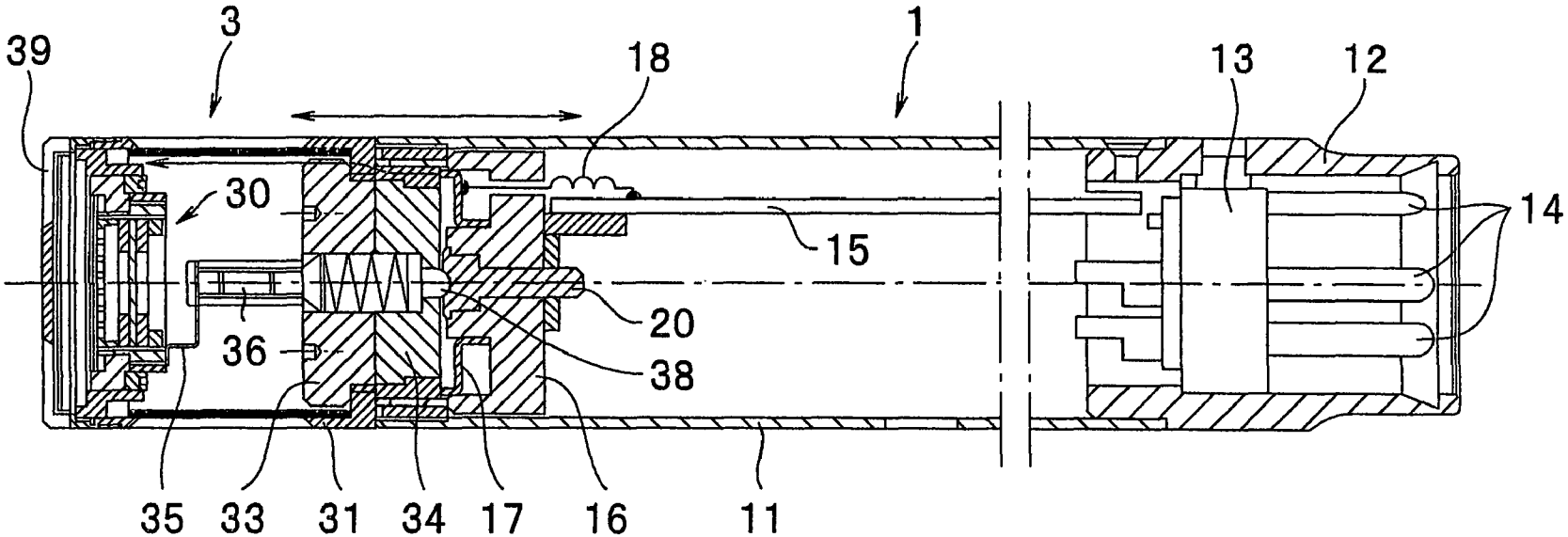
FIG. 1 is a longitudinal sectional view showing an embodiment of a condenser microphone according to the present invention.

An embodiment of a condenser microphone according to the present invention will be described below with reference to drawings. Here, the same reference numerals are attached to the same components as the conventional components shown in FIG. 4 and FIG. 5. In addition, the embodiment schematically shown shows a condenser microphone the microphone unit section of which can be arbitrarily replaced with, for example, a nondirectional microphone unit section, a unidirectional microphone unit section, or a microphone unit section with other specification, however, only one kind of microphone unit section is shown schematically.

Figure 2:
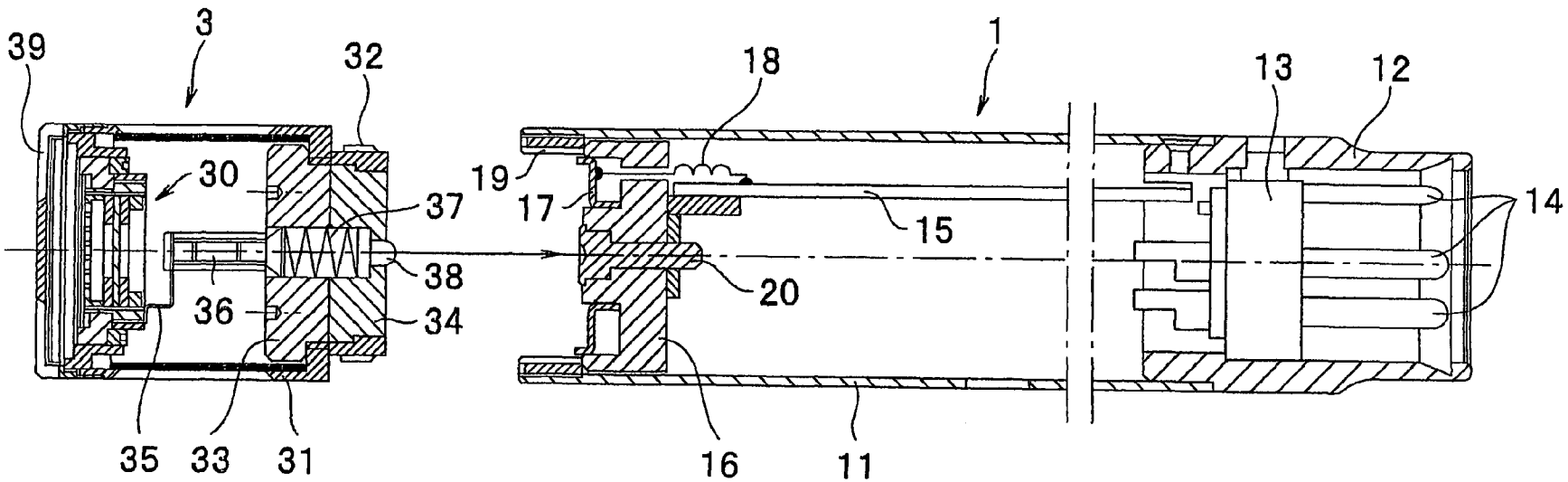
FIG. 2 is a longitudinal sectional view showing the embodiment in a state in which a microphone unit section is separated from a microphone case.

In FIG. 1 and FIG. 2, reference numeral 1 denotes a microphone case and reference numeral 3 denotes a microphone unit section. The microphone unit case 1 has a female screw 19 on the inner circumferential surface of the front end (the left end in FIG. 1 and FIG. 2) and the microphone unit section 3 has a male screw 32 at its rear end. It is arranged such that the microphone unit section 3 is attached to the microphone case 1 by relatively rotating the microphone case 1 and the microphone unit section 3 about their center axial line so as to screw the male screw 32 into the female screw 19 and the microphone unit section 3 is detached from the microphone case 1 by unscrewing the male screw 32 from the female screw 19.

Figure 3A:
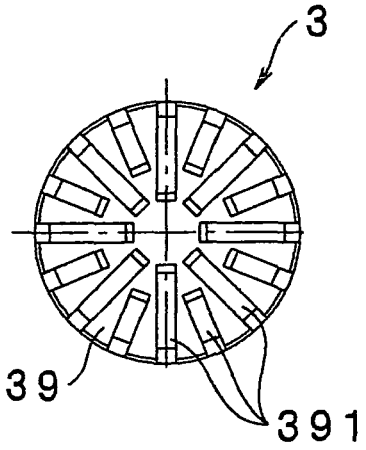
FIGS. 3(*a*) and 3(*b*) show the microphone unit section in the embodiment, wherein FIG. 3(*a*) shows an elevation view and FIG. 3(*b*) shows a side view.
Figure 3B:
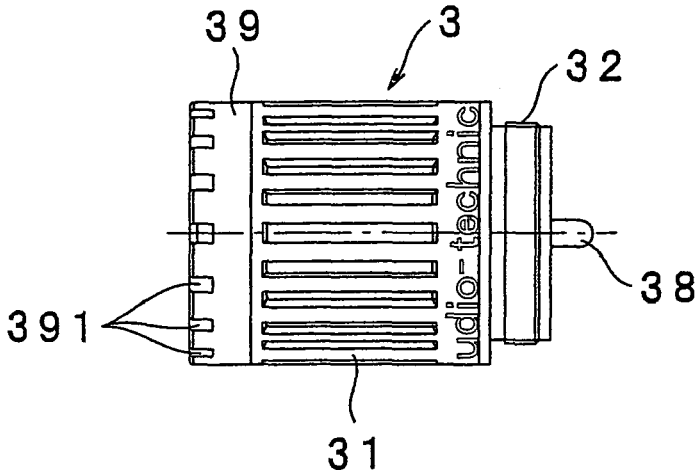

The microphone unit section 3 has a substantially cylindrical unit case 31, and a condenser microphone unit 30 is attached at a position near the front end in the unit case 31. The condenser microphone unit 30 may be one having a general configuration conventionally known, comprising a diaphragm the outer circumferential edge portion on one side of which is held by a holding ring, a fixed electrode arranged in opposition to the holding ring with a small gap in between with the diaphragm produced by an interposed spacer, and other adequate parts. The front end of the unit case 31 is covered with a front cover 39 having a plurality of slit-like sound introduction holes 391 as shown in FIG. 3(*a*) and FIG. 3(*b*). On the front side of the condenser microphone unit 30, there is provided a front side acoustic terminal, which is an inlet of sound. In the case of a unidirectional microphone unit, there is provided a rear side acoustic terminal.

An inner side end plate 33 is engaged with and fixed to the rear end side of the unit case 31 and an outer side end plate 34 is engaged with and fixed to the further outside adjoiningly. A flanged contact 38 is inserted into a stepped hole formed at the center of the outer side end plate 34 and the flange of the contact 38 comes into contact with the step of the hole to prevent the contact 38 from dropping off. A rod-like terminal 36 is inserted into a hole formed in the center of the inner side end plate 33 from outside toward inside, and the terminal 36 is fixed to the inner side end plate 33 in a state of protruding toward the microphone unit 30. A compression spring 37 made of a conductor is interposed in the holes at the centers of the inner side end plate 33 and the outer side end plate 34 and the contact 38 is pressed toward the outside of the outer side end plate 34 by a repulsion of the compression spring 37 and the rear end portion of the contact 38 which is formed into a semispherical shape protrudes outward from the outer side end plate 34. To the front end portion of the rod-like terminal 36, an output terminal plate 35 extending backward from the microphone unit 30 is screwed. Therefore, a sound signal converted by the microphone unit 30 is transmitted to the output terminal plate 35, the terminal 36, the compression spring 37, and the contact 38.

The microphone case 1 mainly comprises a relatively elongated cylindrical case 11, which functions as a grip of the microphone. An end plate 16 is engaged with and fixed to the inner circumferential surface of the front end portion of the cylindrical case 11, located adjoining the female screw 19 and on the rear side thereof. A contact 20 is engaged with and fixed to the end plate 16 so as to penetrate its center in the direction of thickness. A circuit substrate 15 is attached to the inside of the cylindrical case 11 along the length direction. On the circuit substrate 15, the impedance converter circuit composed mainly of the FET, the low cut circuit, and the output circuit described above are incorporated. The contact 20 is connected with an input terminal of the circuit substrate 15 or a solder land that functions as an input terminal via a proper conductive material. A connector case 12 is engaged with and fixed to a rear end portion of the cylindrical case 11 by a screw etc. A connector base 13 having insulation properties is fixed in the connector case 12. Three pins 14 made of a conductive material are buried in the connector base 13, constituting a connector having a standardized three-pin configuration. An output terminal and a ground terminal of the output circuit formed on the circuit substrate 15 are electrically connected with the corresponding pins, respectively.

FIG. 1 shows a state in which the microphone unit section 3 is attached to the microphone case 1 by screwing the male screw 32 of the unit case 31 into the female screw 19 of the cylindrical case 11. The contact 20 arranged in the cylindrical case 11 mainly comprising the microphone case 1 and the contact 38 arranged in the unit case 31 are arranged at the center of the relative rotation for attaching and detaching the microphone unit section 3 to and from the microphone case 1. Further, it is arranged such that both the contacts 20 and 38 of the cylindrical case 11 and the unit case 31 are in contact with each other when the unit case 31 is attached to the cylindrical case 11. The contacts 20 and 38 are contacts for transmitting a sound signal. In the state described above, in which the microphone unit section 3 is attached to the microphone case 1, the contact 38 of the microphone unit section 3 comes into contact with the front end of the contact 20 on the microphone case 1 side and the contact 38 is pressed against the contact 20 by a compressive force of the compression spring 37, thereby the contact 38 and the contact 20 are electrically connected with each other. Therefore, a sound signal converted in the microphone unit 30 and output therefrom is input to the sound signal input terminal of the circuit substrate 15 via the output terminal plate 35, the terminal 36, the compression spring 37, the contact 38, and the contact 20. On the circuit substrate 15, predetermined process such as impedance conversion, low cut, and amplification is performed and an output signal is transmitted to the three pins 14 as an output terminal. One of the three pins 14 is a ground pin connected with the ground. Into the connector case 12, a connector plug conforming to the standards is inserted and a signal is input to an external circuit via the three pins 14 and a microphone cord.

Figure 4:
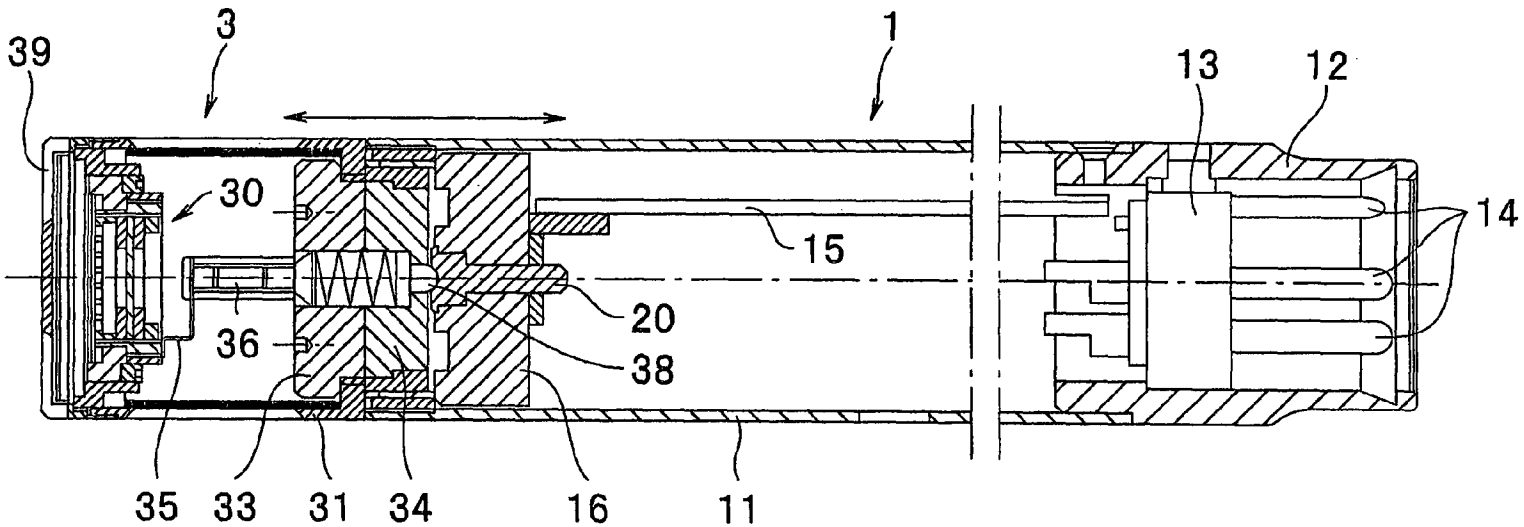
FIG. 4 is a longitudinal sectional view showing an example of a conventional condenser microphone.
Figure 5:
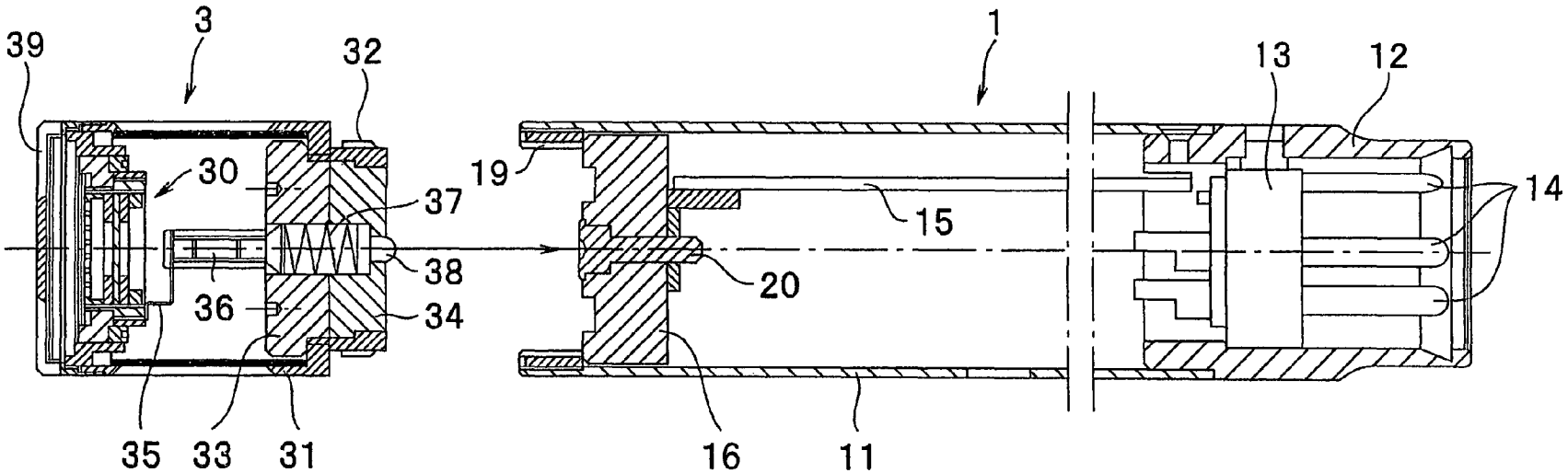
FIG. 5 is a longitudinal sectional view showing the conventional example in a state in which a microphone unit section is separated from a microphone case.

The description so far is substantially the same as that of the configuration of the conventional condenser microphone shown in FIG. 4 and FIG. 5. The configuration described below is a characteristic one of the present invention. In FIG. 1 and FIG. 2, to the end plate 16 made of an insulating material attached internally near the front end of the cylindrical case 11, a contactor 17 is attached on the outer side of the front end, that is, on the microphone unit section 3 side. The contactor 17 is formed into a ring shape and the inner circumferential edge portion of the contactor 17 is drawn and formed into a cylindrical shape toward the inside of the microphone case 1 and the cylindrical inner circumferential edge portion is engaged with the cylinder portion formed into a stepped shape in the end plate 16. The outer circumferential edge portion of the contactor 17 is drawn and formed into a cylindrical shape in the opposite direction to that of the inner circumferential edge portion. The front end of the cylindrical outer circumferential edge portion of the contactor 17 opposes the rear end face of the unit case 31 attached to the microphone case 1 and in a state in which the microphone case 1 and the microphone unit section 3 are coupled to each other by the female screw 19 and the male screw 32 screwed to each other, it is arranged such that the front end of the cylindrical outer circumferential edge portion of the contactor 17 is pressed to and made to come into contact with the rear end face of the unit case 31. The contactor 17 has conductivity and elasticity and in the state described above, in which the front end of the cylindrical circumferential edge portion of the contactor 17 is pressed to and made to come into contact with the rear end face of the unit case 31, it is arranged such that the contactor 17 is warped and biased and by the bias force, the contactor 17 is pressed to and made into contact with the unit case 31 and the contactor 17 is integrally and electrically attached to the unit case 31. It is necessary to arrange so that the contactor 17 can warp as described above. To this end, only the cylindrical portion formed on the inner circumferential side is fixed on the end plate 16 and other portions are put into a state of being floated from the end plate 16. Incidentally, it may be also possible to form a plurality of slits in the radial direction on the portions other than the cylindrical portion of inner circumferential side in order to make it possible for the contactor 17 to warp easily.

To the contactor 17, one end of an inductor 18 is connected. The other end of the inductor 18 is connected to an electrode or a ground pattern formed on the circuit substrate 15 by a proper electrical connecting method such as soldering. The one end side of the inductor 18 penetrates through the end plate 16 and is connected with the contactor 17 by a proper electrical connecting method such as soldering. The ground pattern of the circuit substrate 15 is a one of a sound signal circuit and the ground pattern is connected with the unit case 31 of the condenser microphone unit section 3 as a result via an electric path consisting of the inductor 18 and the contactor 17. In other words, the contactor 17 and the inductor 18 constitute an electric path that electrically connects the rear end of the unit case 31 with the circuit substrate 15 in a state in which the unit case 31 is attached to the microphone case 1.

On the other hand, a high frequency current due to an electromagnetic wave, which tries to enter from the outside flows to the cylindrical case 11 and the unit case 31 through the coupled portion of the cylindrical case 11 and the unit case 31 comprising the microphone case unit 1. To the unit case 31, the high frequency current and a current on the ground side of a sound signal flow, however, in the microphone case 1 and the coupled portion of the cylindrical case 11 and the unit case 31 at which the sound signal is subject to the high frequency current, the electric path of the high frequency current and the electric path on the ground side of the sound signal are separated by the inductor 18, therefore, it is no longer likely that noises caused by the high frequency current enter into the sound signal and thus a condenser microphone with high sound quality can be obtained.

The present invention can be applied to a condenser microphone that has made it possible to detachably attach a microphone unit to a microphone case. In particular, the present invention is effective for a condenser microphone that has made it possible to select and attach a microphone unit section having different specifications to a microphone case. In such a case, it is only necessary to make it possible for the unit case to select an arbitrary one of a plurality of unit cases classified according to specification for each condenser microphone unit and attach the unit case to the microphone case. To this end, it is necessary to make common the specifications of the coupled portion of the unit case and the microphone case even if the specifications of the condenser microphone unit are different.

What is claimed is:

1. A condenser microphone comprising:

a microphone case containing circuitry, the circuitry including a first electrical path to receive a sound signal and a circuit substrate which is connected to a contactor via an inductor to form a second electrical path to receive a high frequency current, the first electrical path electrically separated from the second electrical path by the inductor; and a unit case which is detachably attached to the microphone case and incorporates a condenser microphone unit to transmit the sound signal to the circuitry via the first electrical path, the second electrical path electrically connecting a rear end of the unit case with the circuit substrate via the contactor and the inductor when the unit case is attached to the microphone case.

2. The condenser microphone according to claim 1, wherein the inductor is connected with a ground electrode of the circuit substrate and the unit case functions as a ground side electric path of the sound signal in a state in which the unit case is attached to the microphone case.

3. The condenser microphone according to claim 1, wherein the microphone case and the unit case are attached detachably by relatively rotating so as to screw or unscrew both screws.

4. The condenser microphone according to claim 1, wherein the unit case is selected arbitrarily out of a plurality of unit cases which is classified for each condenser microphone unit having different specification and is attachable to the microphone case.

5. The condenser microphone according to claim 1, wherein the contactor has elasticity and is biased by being pressed by the rear end of the unit case in a state in which the unit case is attached to the microphone case.

6. The condenser microphone according to claim 3, wherein the microphone case and the unit case have respective contacts for transmitting a sound signal at the center of the relative rotation at the time of attachment and detachment and it is arranged such that both the contacts of the microphone case and the unit case come into contact with each other in a state in which the unit case is attached to the microphone case.

* * * * *